US008047394B2

(12) United States Patent
Hansen

(10) Patent No.: US 8,047,394 B2
(45) Date of Patent: Nov. 1, 2011

(54) SAFETY DEVICE FOR AT LEAST ONE CONTAINER, IN PARTICULAR A BLOW-MOUDED PLASTIC CONTAINER

(76) Inventor: Bernd Hansen, Sulzbach-Laufen (DE)

( * ) Notice: Subject to any disclaimer, the term of this patent is extended or adjusted under 35 U.S.C. 154(b) by 358 days.

(21) Appl. No.: 12/224,776

(22) PCT Filed: Feb. 2, 2007

(86) PCT No.: PCT/EP2007/000893

§ 371 (c)(1),
(2), (4) Date: Sep. 5, 2008

(87) PCT Pub. No.: WO2007/112802

PCT Pub. Date: Oct. 11, 2007

(65) Prior Publication Data

US 2009/0101650 A1 Apr. 23, 2009

(30) Foreign Application Priority Data

Apr. 5, 2006 (DE) ..... 10 2006 015 913

(51) Int. Cl.

| | |
|---|---|
| ***B65D 41/32*** | (2006.01) |
| ***B65D 17/52*** | (2006.01) |
| ***B65D 47/02*** | (2006.01) |
| ***B65D 1/02*** | (2006.01) |
| ***B65D 47/10*** | (2006.01) |

(52) U.S. Cl. ..... 220/284; 220/266; 215/14; 215/46; 215/47; 215/48; 215/49; 215/253; 222/541.6; 222/541.9

(58) Field of Classification Search ..... 220/266, 220/284, 315; 215/47, 48, 49, 253, 14, 46; 222/541.6, 541.9

See application file for complete search history.

(56) References Cited

U.S. PATENT DOCUMENTS

| | | | | |
|---|---|---|---|---|
| 4,512,475 | A * | 4/1985 | Federighi | 206/484 |
| 5,577,636 | A | 11/1996 | Fukuoka et al. | |
| 5,897,009 | A * | 4/1999 | O'Meara | 215/48 |
| 5,908,124 | A | 6/1999 | Klauke et al. | |
| 5,932,235 | A | 8/1999 | Ninomiya et al. | |
| 5,944,206 | A | 8/1999 | Culter et al. | |
| 6,874,665 | B2 * | 4/2005 | Doherty et al. | 222/541.5 |
| 2003/0146245 | A1 | 8/2003 | Weiler et al. | |

FOREIGN PATENT DOCUMENTS

| | | |
|---|---|---|
| DE | 2 213 887 | 10/1973 |
| DE | 27 14 917 A1 | 10/1978 |

* cited by examiner

*Primary Examiner* — Anthony Stashick
*Assistant Examiner* — Madison L Wright
(74) *Attorney, Agent, or Firm* — Roylance, Abrams, Berdo & Goodman, L.L.P.

(57) ABSTRACT

A safety device for at least one container, in particular a blow-molded plastic container, preferably in ampoule form, has a supply part (5) for accommodating a medium which can be dispensed via a container opening (9). The container opening (9) can be closed by a first safety part (11) which counteracts opening forces with a predefinable resistance. The predefinable resistance can be overcome for the release of the container opening (9) with the aid of a second safety part (15) which interacts with the first safety part (11).

8 Claims, 3 Drawing Sheets

SAFETY DEVICE FOR AT LEAST ONE CONTAINER, IN PARTICULAR A BLOW-MOUDED PLASTIC CONTAINER

FIELD OF THE INVENTION

The invention relates to a safety device for at least one container, in particular a blow-moulded plastic container, preferably in ampule form, having a storage part for holding a medium which can be dispensed via a container opening.

BACKGROUND OF THE INVENTION

As is recognized, safety devices for containers are advantageous or even essential in instances where the medium is to be prevented from being easily dispensed from the container, more exactly, from being dispensed without the need for special measures for clearance of the container opening. The increased difficulty of removing the contents of the pertinent container resulting from the safety device is especially necessary as a child safety feature when hazardous media are contained in the container. Contact or oral ingestion of hazardous media at least for a certain group of individuals, for example children, would have fatal consequences.

This circumstance relates in particular to blow-molded plastic containers in ampule form, produced, for example, from plastic, and filled and sealed for example using the known Bottelpack® process. These ampules often contain fluids for therapeutic purposes, whose use is intended only for certain individuals, with a child safety feature being especially necessary.

SUMMARY OF THE INVENTION

With respect to this problem, an object of the invention is to provide a safety device for containers whose storage part contains a dispensable medium that enables dispensing of the medium only when certain actions corresponding to a predetermined operating sequence are carried out, whose execution is not apparent in particular to children.

According to the invention, this object is basically achieved by a safety device for the closure of the container having a first safety part counteracting the opening forces with a resistance which can be overcome using a second safety part interacting with the first safety part. In this connection, a definable resistance can be chosen such that it can hardly be overcome without the aid of the second safety part or in any case not by children. Easy or unintentional opening is made difficult. It is especially ensured that children are not able to execute the operating sequence necessary for opening the container opening without instructions.

Containers in ampule form can often be found commercially in the form of a "multiblock" of several interlocked ampules. This version further contributes to child safety by prior separation of the container from the ampule block being necessary as a further complication of the opening process.

For units joined into a multiblock of several containers, each container is provided with its own second safety part. Alternatively, a single safety part can be assigned to each multiblock and it can be removably attached, for example, to the multiblock or can be stowed on it.

When each container is assigned its own second safety part, it is preferably removably attached to the assigned container.

For blow-molded plastic containers, the second safety part preferably is molded in one piece on the assigned container and can be removed by breaking at the predetermined point of separation.

Preferably, the first safety part is a closure part molded in one piece on the container opening with the formation a second predetermined point of separation on the head end of the storage part. The second predetermined point of separation counteracts the opening forces with the definable resistance. In an especially advantageous manner, the second safety part can be formed by a head part with the head end of the storage part having the container opening molded on the storage part and on the closure part in one piece by a first predetermined point of separation. Advantageously, in this instance the safety device with first and second safety parts forms a unit which can be made in one piece in the production and filling of the container, such as using the Bottelpack® process.

The arrangement can be made such that the first predetermined point of separation counteracts the removal of the head part with a resistance, which resistance is less than the definable resistance with which the second predetermined point of separation counteracts the removal of the closure part from the container opening. The attempt to open the container by the head part being removed by breaking the first predetermined point of separation, a process which is also obvious in this regard to children, does not result in clearance of the container opening. As a result of the lower resistance with which the first predetermined point of separation counteracts the removal of the head part, on the closure part not so great an opening force takes effect which would be sufficient to overcome the definable resistance with which the second predetermined point of separation counteracts the removal of the closure part.

Thus, for the opening process a second step is necessary which can be implemented using the second safety part. This example uses the head part which has been removed from the container.

In advantageous embodiments, the head part has a handling part which can be manually grasped. At least one tool part with action surfaces can be caused to engage the assigned contact surfaces of the closure part in order to overcome the resistance formed by the second predetermined point of separation for clearance of the container opening.

Preferably the closure part on its exterior has a nonround, preferably polygonal shape, forming contact surfaces for the action surfaces of the tool part which easily enable transmission of torque from the tool part to the closure part. The closure part can then be twisted off the container opening at the second predetermined point of separation.

In one especially advantageous embodiment, the head part is formed by a body in the form of a plate with side edges extending opposite one another in an extension of the exterior of the storage part and with an end edge connecting the side edges. In the plate as the tool part at least one depression is recessed, and has wall sections matched to the nonround shape of the exterior wall of the closure part to form the action surfaces of a turning tool for twisting off the closure part.

The arrangement can be made such that after removing the plate-like body forming the head part, a mouthpiece for oral use of the container is available on the head end of the storage part. The mouthpiece is formed by tapering of the head end of the storage part. The taper is formed by a pair of symmetrical concave surfaces opposite one another. The ends of the concave surfaces form the narrow side of the taper and border the first predetermined point of separation, that is, the end edge of the head end formed after removal of the head part.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 2:
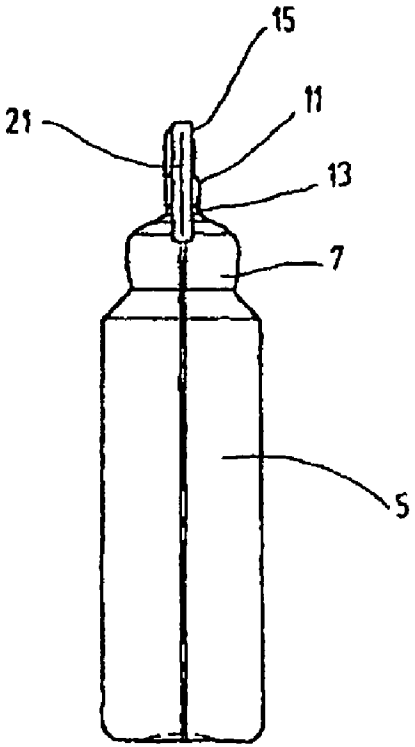
FIG. 2 is a side elevational view of the multiblock of FIG. 1.
Figure 1:
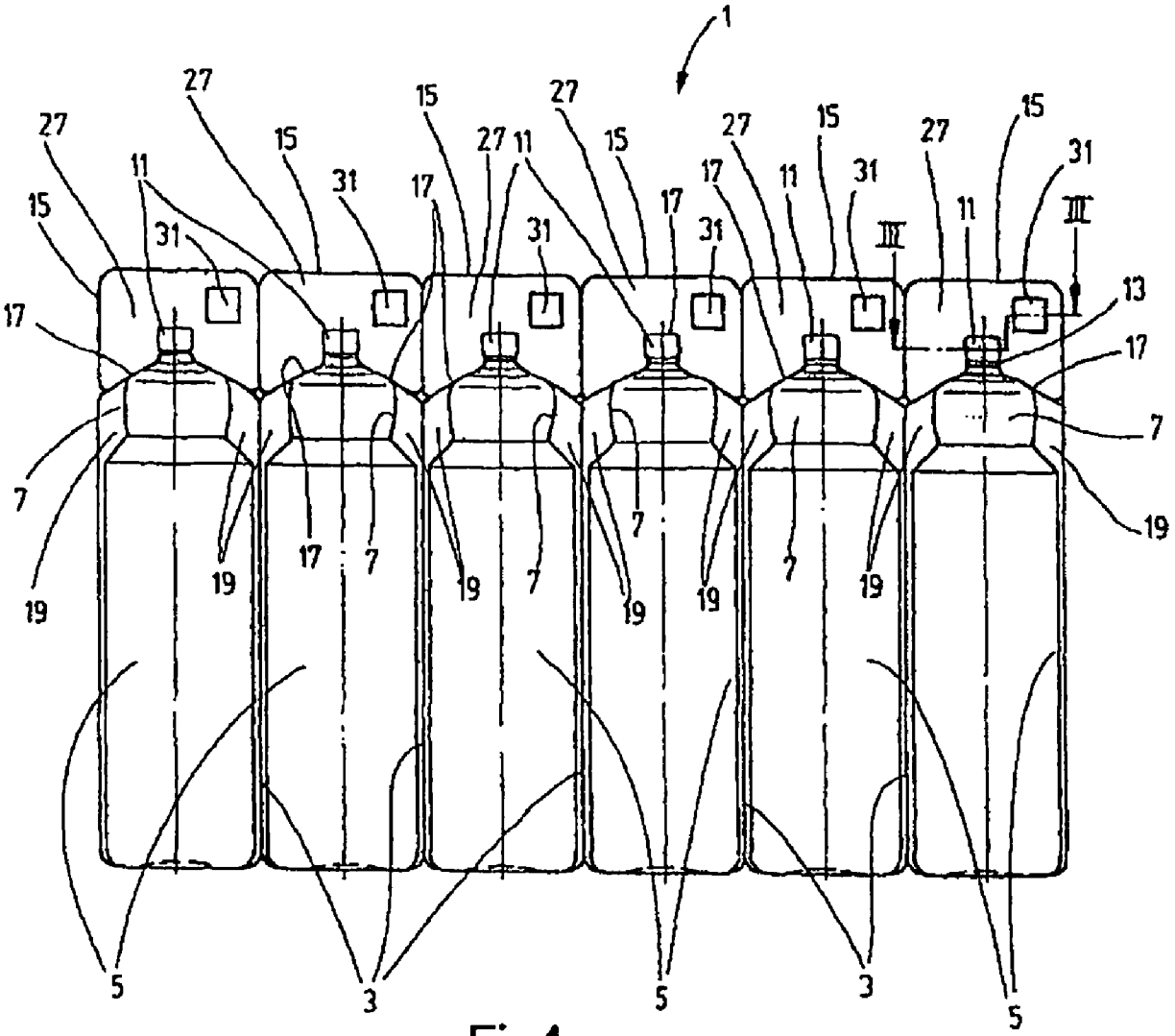
FIG. 1 is a front elevational view of a multiblock shown approximately in natural size, with six interlinked blow-molded plastic containers in ampule form, each with a safety device according to a first exemplary embodiment of the invention.
Figures 3, 4, 5, 6, 7, 8:
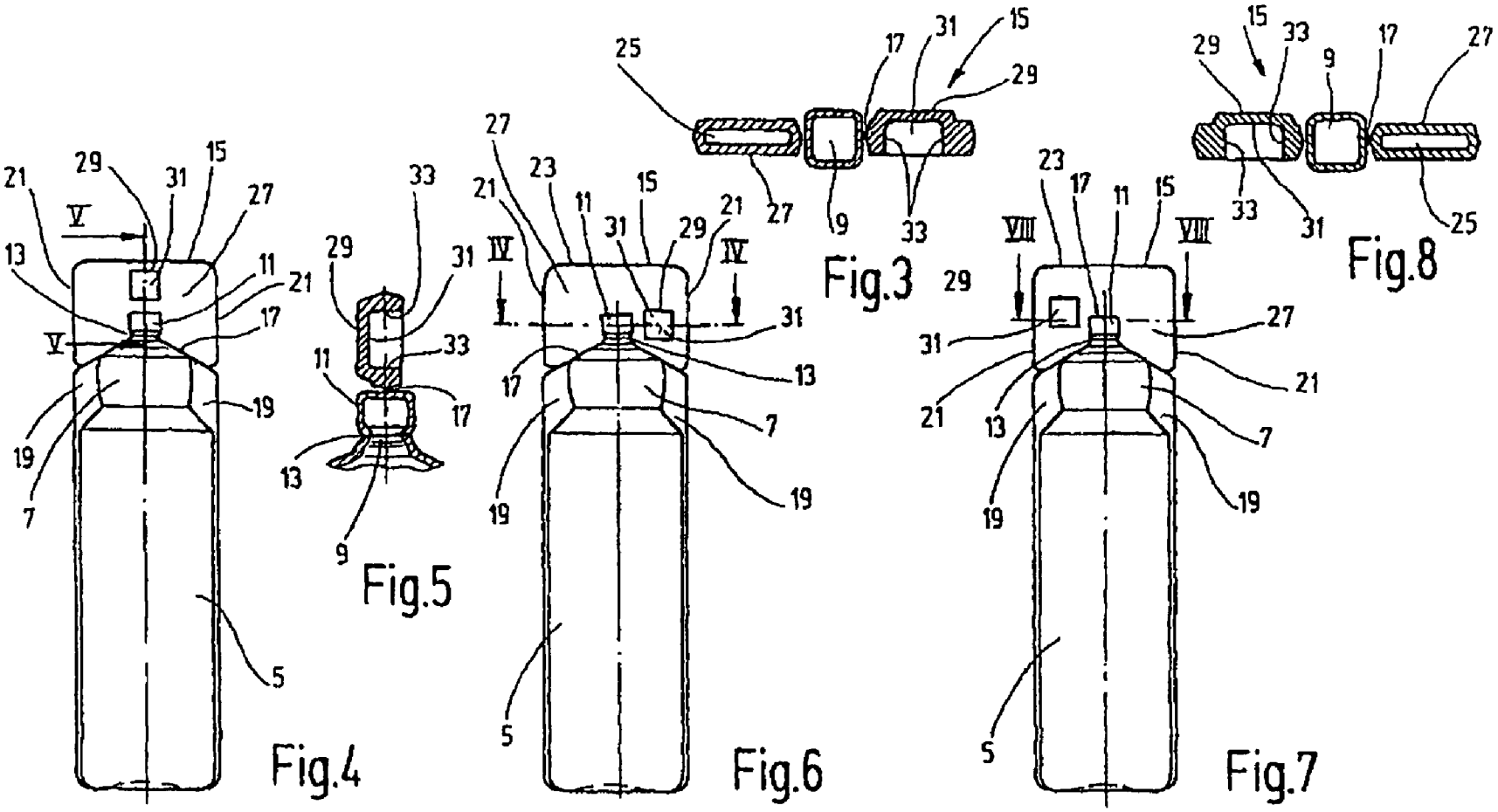
FIG. 3 is a top plan view in section of a container taken along line of FIG. 1 and also along line IV-IV of FIG. 6.
FIG. 4 is a front elevational view of an individual, blow-molded plastic container in ampule form with a safety device according to a second exemplary embodiment of the present invention.
FIG. 5 is a partial side elevational view in section of the container taken along line V-V of FIG. 4.
FIG. 6 is a front elevational view of an individual, blow-molded plastic container in ampule form with a safety device according to a third exemplary embodiment of the invention.
FIG. 7 is a front elevational view of an individual, blow-molded plastic container in ampule form with a safety device according to a fourth exemplary embodiment of the invention.
FIG. 8 is a top plan view in section of a container taken along line VIII-VIII of FIG. 7.
Figure 9:
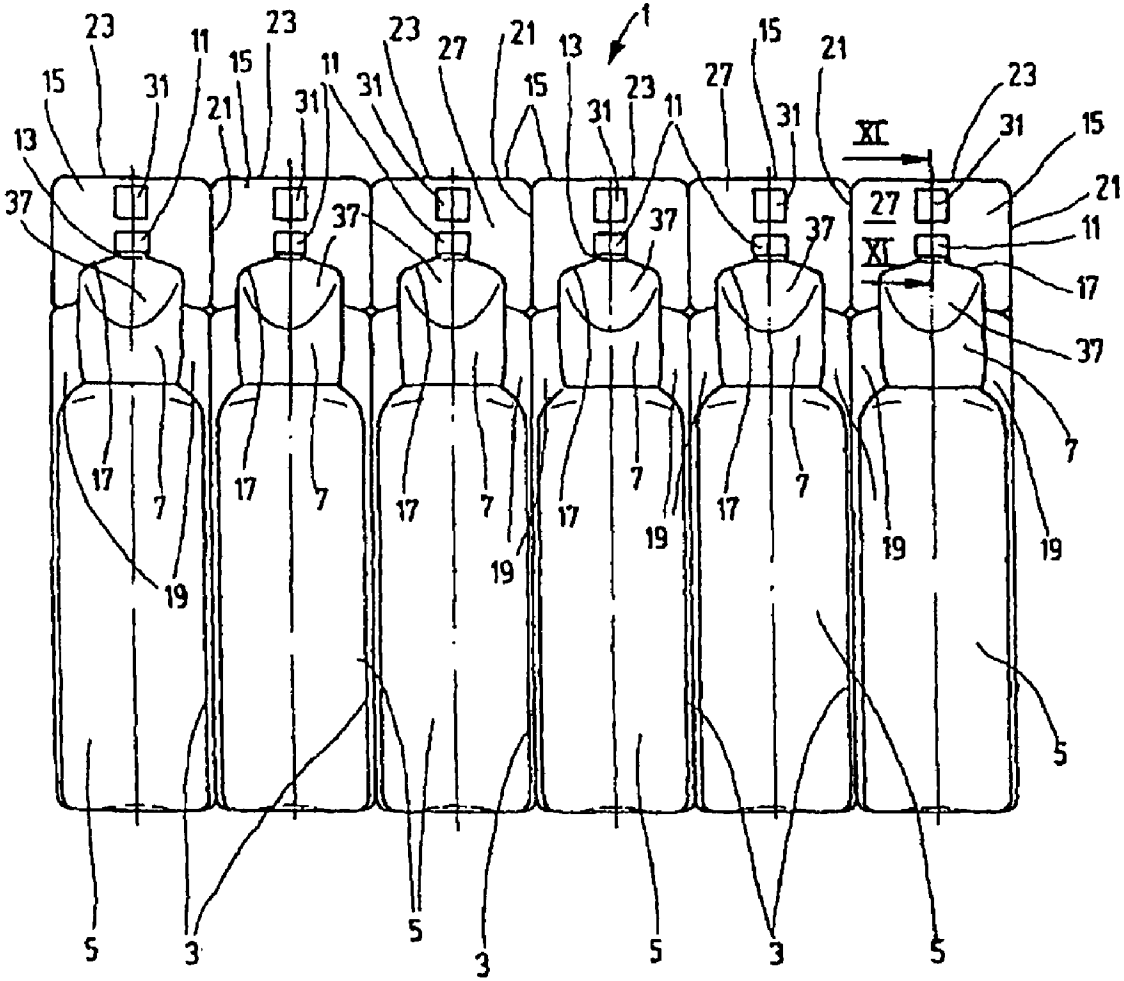
FIG. 9 is a front elevational view of a multiblock shown approximately in natural size, with six interlinked blow-molded plastic containers in ampule form, each with a safety device according to a fifth exemplary embodiment according to the invention.

The invention is explained below using several embodiments having safety devices, each in the form of a child safety feature making the opening process difficult for blow-molded plastic containers in ampule form. These ampules can be produced in one piece, for example, using the Bottelpack® process, can be filled sterile and can be sealed. Combined into a multiblock, these ampules can be marketed as a unit of several ampules. In FIGS. 1 and 9 a multiblock 1 has six ampules interlinked at points of separation 3. Each ampule has an essentially circularly cylindrical storage part 5 with an upper head part 7 extending with formation of a constriction to the container opening 9 (FIG. 3) sealed by a closure part 11 molded on in one piece. As seen from FIGS. 5 and 11, the closure parts 11 are molded to the respective container opening 9 with the formation of a predetermined point of separation 13 referred to as the "second predetermined point of separation" hereinafter.

As the upper termination of the overall ampule unit, a head part 15 is molded on the top of the head end 7 by the predetermined point of separation 17 referred to as the "first predetermined point of separation" hereinafter. This first predetermined point of separation 17 extends both along the top of the head part 7 on the storage part 5 and also beyond the exterior of the respective closure part 11. Moreover, the first predetermined point of separation 17 extends along the end edge of the lateral edge wings 19 forming an extension of the points of separation 3 on the exterior of the storage part 5. While the second predetermined point of separation 13 is made capable of resistance between the container opening 9 and the closure part 11, the first predetermined point of separation 17 is made to be easily broken. If therefore the pertinent head part 15 is removed by breaking the first predetermined point of separation 17, as a result of the resistance capacity of the second predetermined point of separation 13 the closure part 11 remains on the container opening 9, i.e., removal of the head part 15 does not lead to clearance of the container opening 9.

The respective head parts 15 have the shape of a plate-like body with side edges 21 forming an extension of the edges of the edge wings 19 and with end edges 23 extending at a right angle thereto. For the embodiments of FIGS. 1 to 11, the head parts 15 are made partially as hollow bodies with cavities 25 (FIG. 3). They can also be made in the manner of a solid body. Each head part 15 has a flat handling part 27 and a tool part 29. The tool part 29 has a depression 31 forming the actual actuating tool. Comparison of FIGS. 1, 4, 6 and 7 shows that there can be depressions 31 in the head parts 15 at different locations. As is likewise apparent from the figures, particularly FIGS. 3, 5 and 11, the depressions 31 have action surfaces 33 extending at right angles to one another. As is likewise apparent from FIGS. 5 and 11, the closure part 11 has an essentially quadratic outline shape. The head part 15 is removed by breaking the first predetermined point of separation 17 and then grasped on the handling part 27 to be used as a turning tool by the tool part 29 being seated within a depression 31 on the closure part 11. The action surfaces 33 adjoin the contact surfaces on the exterior of the closure part 11 which is quadratic in outline, and thus, cause the transfer of torque to the closure part 11 when the head part 15 is twisted. The resistance with which the twisting-off of the closure part 11 by the second predetermined point of separation 13 is counteracted can be overcome by the corresponding handling of the head part 15. While simple removal of the head part 15 does not result in clearance of the container opening 9, the opening process is made simple and comfortable when a second handling step is executed by the action surfaces 33 of the depression 31 engaging the contact surfaces on the closure part 11 by manipulation of the head part 15 by the handling part 27 and rotary motion executed to twist the second predetermined point of separation 13.

Figure 11:
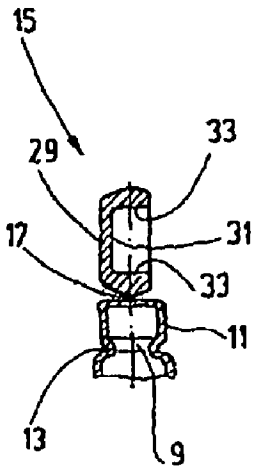
FIG. 11 is a partial side elevational view in section of a container taken along line XI-XI of FIG. 9.
Figure 10:
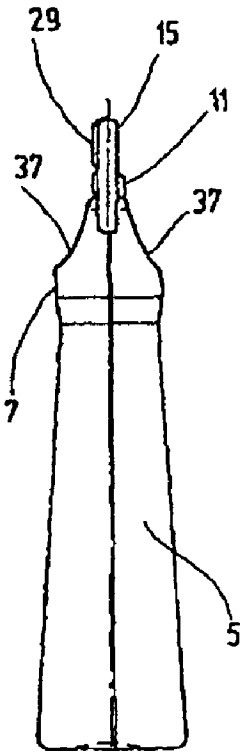
FIG. 10 is a side elevational view of the multiblock of FIG. 9.

FIGS. 9 to 11 illustrate one embodiment in which the plastic container is made as a drinking ampule. In contrast to the other examples, the storage part 5 in the direction to the head end 7 is tapered in a slightly conical shape. To form the mouthpiece, the head end 7 itself has concavely curved surfaces 37. The ends of the surfaces 37 form the narrow side of the taper bordering the first predetermined point of separation 17. When the container opening 9 is cleared, comfortable oral administration of the contents of the storage part 5 is enabled.

In the illustrated example, in the head part 15, a respective depression 31 is provided as the tool part. When the head part 15 is dimensioned accordingly, two or more depressions can be provided.

While the invention is explained above using examples which relate to comparatively small-volume containers in ampule form, the invention can be equally applied to other types of containers, for example, to larger volume containers for beverages, with or without the mouthpieces molded thereon, or containers of another type.

While various embodiments have been chosen to illustrate the invention, it will be understood by those skilled in the art that various changes and modifications can be made therein without departing from the scope of the invention as defined in the appended claims.

What is claimed is:

1. A safety container, comprising:

a storage part for holding a medium having a head end with a container opening for dispensing the medium;

a removable first safety part sealing said container opening and being a closure part with contact surfaces molded as one piece on said container opening via a second predetermined point of separation on said head end, said second predetermined point of separation counteracting opening forces with a second resistance that can be overcome for clearing said container opening; and a removable second safety part interactable with said first safety part and being a head part molded on said head end and said closure part in one piece via a first predetermined point of separation, said first predetermined point of separation counteracting removal of said head part with a first resistance less than said second resistance, said head part having a manually graspable handling part and at least one tool part with action surfaces engagable with said contact surfaces of said closure part for twisting said closure part and overcoming said second resistance to clear said container opening.

2. A safety container according to claim 1 wherein said storage part, said first safety part and said second safety part are a unitary, one-piece structure of blow-molded plastic.

3. A safety container according to claim 1 wherein said storage part is joined to storage parts of other containers into a multiblock, each of said other containers having one of said first safety part and one of said second safety part, said containers being in ampule form.

4. A safety container according to claim 1 wherein said contact surfaces form a non-round exterior wall allowing said tool part to apply torque to said closure part for twisting said closure part off said container opening at said second predetermined point of separation.

5. A safety container according to claim 4 wherein said exterior wall is polygonal.

6. A safety container according to claim 4 wherein said head part has plate-shaped configuration, has side edges extending opposite one another on an extension of exteriors of said storage part and has an end edge connecting said side edges, said tool part having at least one depression with wall sections mated to said non-round exterior wall of said closure part to form said action surfaces.

7. A safety container according to claim 6 wherein said closure part has a mostly rectangular outline and said wall sections of said depression that are adjacent extending at right angles to one another.

8. A safety container according to claim 1 wherein said head end of said storage part forms a mouthpiece for oral use and has a taper provided by a pair of symmetrical concave surfaces opposite one another and having ends forming a narrow side of said taper bordering said first predetermined point of separation.

* * * * *